US007186174B1

(12) United States Patent
Arnold

(10) Patent No.: US 7,186,174 B1
(45) Date of Patent: Mar. 6, 2007

(54) SANDING BLOCK HOLDER

(76) Inventor: Alfred W Arnold, 937 Spur Dr. N., Bay Shore, NY (US) 11706-3354

( * ) Notice: Subject to any disclaimer, the term of this patent is extended or adjusted under 35 U.S.C. 154(b) by 0 days.

(21) Appl. No.: 11/124,895

(22) Filed: May 9, 2005

(51) Int. Cl.
*B24D 15/00* (2006.01)

(52) U.S. Cl. ..... 451/524; 451/525; 451/507

(58) Field of Classification Search ..... 451/523, 451/524, 525, 344, 354, 507
See application file for complete search history.

(56) References Cited

U.S. PATENT DOCUMENTS

| | | | | | |
|---|---|---|---|---|---|
| 846,665 | A | * | 3/1907 | Hames | 451/524 |
| 1,024,015 | A | * | 4/1912 | Miller | 451/516 |
| 1,501,192 | A | | 7/1924 | Severns | |
| 2,280,767 | A | * | 4/1942 | Ferragano | 51/187 |
| 2,711,059 | A | | 6/1955 | Ames | |
| 3,964,213 | A | | 6/1976 | Tobey | |
| 4,023,312 | A | * | 5/1977 | Stickney | 451/557 |
| 4,414,700 | A | | 11/1983 | Burns | |
| 4,475,317 | A | | 10/1984 | Dicke | |
| 4,896,465 | A | * | 1/1990 | Rhodes et al. | 451/523 |
| 5,103,599 | A | * | 4/1992 | Carlson | 451/514 |
| 5,179,807 | A | | 1/1993 | Gupton | |
| 5,245,797 | A | | 9/1993 | Milkie | |
| 5,855,505 | A | | 1/1999 | Letts | |
| 5,895,316 | A | * | 4/1999 | Williams | 451/524 |
| 5,902,176 | A | * | 5/1999 | Chen | 451/524 |
| 6,095,911 | A | * | 8/2000 | Edens | 451/524 |
| 6,116,999 | A | | 9/2000 | Montross | |
| RE37,486 | E | * | 12/2001 | Stanzione | 451/523 |
| 6,379,237 | B1 | * | 4/2002 | Gordon | 451/523 |
| 6,616,519 | B2 | * | 9/2003 | Mansfield | 451/512 |

FOREIGN PATENT DOCUMENTS

| | | |
|---|---|---|
| CA | 683.644 | 4/1964 |
| EP | 0.635.335 | 1/1995 |

* cited by examiner

*Primary Examiner*—Eileen P. Morgan
(74) *Attorney, Agent, or Firm*—Michael I. Kroll

(57) ABSTRACT

Apparatus 10 discloses a sanding block holder incorporating locking tabs 22 used to lock the removable side wall 20 into a compressing state upon the sanding block 16. To release compression on the sponge 16, the tab 22 is simply pushed inward and the removable side wall 20 is then pulled out. Additionally a track 24 with a sliding tab 26 are fabricated to work in cooperation with the handle base 18 and locking tab 22 to provide stability to the removable side wall while sliding into place. An elongated handle 32 pivotally attached at 34 to the handle base 18 is also disclosed.

12 Claims, 9 Drawing Sheets

SANDING BLOCK HOLDER

BACKGROUND OF THE INVENTION

1. Field of the Invention

The present invention relates generally to sanding tools and, more specifically, to a sanding block holder incorporating locking tabs used to lock the removable side wall into a compressing state upon the sanding block. To release compression on the sponge, the tab is simply pushed inward and the removable side wall is then pulled out. Additionally a track with a sliding tab are fabricated to work in cooperation with the handle base and locking tab to provide stability to the removable side wall while sliding into place.

During installation the sanding block is pressed in-between the locking tabs, handle base and removable side wall wherethen the removable side wall is pressed into place inside of the handle base where it then may be adjusted and compressed into a tab locking position of sufficient compression whereby the sanding blocks unsupported side portions flare out to and extent exceeding the handle base's outside perimeter.

2. Description of the Prior Art

There are other holder device designed for tools. Typical of these is U.S. Pat. No. 1,501,192 issued to Severns on Jul. 15, 1924.

Another patent was issued to Ames on Jun. 21, 1955 as .U.S. Pat. No. 2,711,059. Yet another U.S. Pat. No. 3,964,213 was issued to Tobey on Jun. 22, 1976 and still yet another was issued on Nov. 15, 1983 to Burns as U.S. Pat. No. 4,414,700.

Another patent was issued to Dicke on Oct. 9, 1984 as U.S. Pat. No. 4,475,317. Yet another U.S. Pat. No. 5,179,807 was issued to Gupton on Jan. 19, 1993. Another was issued to Milkie on Sep. 21, 1993 as U.S. Pat. No. 5,245,797 and still yet another was issued on Jan. 5, 1999 to Letts as U.S. Pat. No. 5,855,505.

Another patent was issued to Montross on Sep. 12, 2000 as U.S. Pat. No. 6,116,999. Yet another Canadian Patent No. CA683644 was issued to Hoveland on Apr. 7, 1964 and still yet another was published on Jan. 25, 1995 to Cheney et al. as European Patent Application No. EP0635335.

U.S. Pat. No. 1,501,192

Inventor: William Severns

Issued: Jul. 15, 1924

A floor polishing device, comprising a base formed with an upstanding flange and a central integral lug, an arc-shaped spring plate, threaded bolts fixed to said base and at their upper ends passing through apertures in said spring plate, wing nuts on said bolts adapted to engage the upper surfaces of said spring plate to flatten the same and to grip a finishing material between the plate edges and the inner faces of the flange on said base, and a handle-receiving socket pivoted to the central lug on said base and projecting freely through a central slot in said spring plate.

U.S. Pat. No. 2,711,059

Inventor: Robert G. Ames

Issued: Jun. 21, 1955

A universal sander comprising a body having a front and a rear face with an opening extending entirely therethrough; a strip of sandpaper having a portion covering the front face and extending across the opening; a handle; and a universal joint connecting the handle to the body at the rear face and including a ring; a pin pivotally connecting the handle to the ring; said ring being pivotally connected to-the body and being swingable about an axis that extends at right angles to the pin; said ring being free to swing into said body opening and being dimensioned so as to clear the back of the sandpaper portion that covers the opening while permitting the handle to be swung into a plane paralleling the front body face.

U.S. Pat. No. 3,964,213

Inventor: Alton E. Tobey

Issued: Jun. 22, 1976

An abrasive cleaning tool for underwater cleaning of fouled hull bottoms, swimming pools and the like; the cleaning tool has a connecting arm for attachment to an elongated handle, a head assembly to which a contoured wire screen, coated with a particulate abrasive, is attached; the head assembly includes a supporting surface for the wire screen having ridge elements for displacing the screen from the supporting surface for flushing action on the screen during use.

U.S. Pat. No. 4,414,700

Inventor: Frederick B. Burns

Issued: Nov. 15, 1983

A device for preparing a surface for painting by removing old, peeling paint, dirt and similar material includes a mounting base to which a handle is attached. A pad is removably secured to the base to provide an abrasive/cleaning surface and, in one embodiment, includes an inner portion of absorbent material surrounded by a second portion of abrasive material. The absorbent portion will hold a supply of cleaning fluid, such as water or paint thinner to facilitate the cleansing process. In an alternative embodiment, the pad includes an inner abrasive material portion surrounded by an absorbent material.

U.S. Pat. No. 4,475,317

Inventor: William C. Dicke

Issued: Oct. 9, 1984

An in-line sander for hand held operation and having a housing in which a rotating electric motor drives a drive shaft to rotate on a first axis, with a second axis of the drive shaft canted to the first axis and supporting a bearing thereon. A wobble housing is supported on the bearing to orbit therewith, the wobble housing having an arm extending to a platen support and extensibly and pivotably connected to a portion thereof. This orbiting of the wobble housing influences motion of the platen support in accordance with the angle of the cone described by the second axis of the drive shaft. The platen support is made of a resilient material and carried by the housing on legs extending to a base portion, which legs have a low moment of inertia in the direction of in-line sanding, and a high moment of inertia normal to the direction of in-line sanding, so as to be disposed to motion in the in-line sanding path only. A platen is attached to the platen support by a key and key slot, one on each, which permits assembly when misaligned and retains the platen to the platen support when rotated to an aligned position. Resilient paper clamps are provided which cooperate with grooves in the upper surfaces of posts on the platen, to retain sand paper to the platen.

U.S. Pat. No. 5,179,807

Inventor: Donald W. Gupton

Issued: Jan. 19, 1993

Presented is a floor sanding device having a relatively large shoe member on the bottom of which is attached a cushioning layer adapted to receive an elongated strip of abrading material, such as sandpaper, for clamping to the shoe member. A handle is pivoted to the top surface of the shoe member and possesses a length sufficient to enable reciprocation of the floor sanding device by a workman from a standing position.

U.S. Pat. No. 5,245,797

Inventor: Terry H. Milkie

Issued: Sep. 21, 1993

A manual sanding tool has a block for holding a sheet of sand paper and a housing which may be attached to the block. The block has two ridges, each with a convex top surface. The two ridges are proximate opposed sides of the block; a shaft projects from the block inwardly of, and adjacent to, each ridge. An inverted box shaped member associated with each ridge has an elongate slot which receives the shaft such that the box member may be wiped over the top of the ridge to a position on the back surface of the block. In wiping over the top surface of the ridge, the box shaped member pulls on the end of any sandpaper between it and the ridge in order to tighten the sandpaper on the block. A nut may then secure the box shaped member in place on the back surface of the ridge. A passageway through a clip attached to the housing may receive a smaller diameter hook. The hook terminates in a socket for receiving a pole. This arrangement forms a reach extension for the tool with the hook and larger diameter passageway acting as a universal joint.

U.S. Pat. No. 5,855,505

Inventor: Joshua E. Letts

Issued: Jan. 5, 1999

A surface leveling tool for sanding wooden, painted and plastic surfaces without gouging. The tool comprises a handle of variable length attached to a head with a clamping element which holds a flexible plastic sandpaper insert. A specially formatted sandpaper sheet is adhered to the flexible plastic insert. The plastic insert has a cross-section analogous to a J-shape and is clamped only by the hooked portion. This arrangement provides for space between the unclamped portion of the sandpaper covered insert and the clamp. The clamp utilizes fasteners which are tightened and loosened by a hidden screwdriver in the grip of the handle.

U.S. Pat. No. 6,116,999

Inventor: Christopher G. Montross

Issued: Sep. 12, 2000

A sander (20) for a bullnose cornerbead (500) includes a body (22) having a bullnose-shaped concave surface (24) having a second radius of curvature (R.sub.2) greater than the first radius of curvature (R.sub.1) of the bullnose cornerbead (500). A flexible pad (26) is disposed on concave surface (24), and forms a third radius of curvature (R.sub.3) which is greater than first radius of curvature (R.sub.1), and less than second radius of curvature (R.sub.2). Pad (26) does not fully extend to the edges (34) and (36) of sander (20), thereby leaving two gaps (38) and (40). A sheet of abrading material (700) such as sandpaper or emery cloth is clamped adjacent to flexible pad (26) and around concave surface (24) of sander (20). A handle (800) is connected to a pivotable connector (48) which only pivots in one plane (50).

Canadian Patent Number CA683644

Inventor: Julian C. Hoveland

Issued: Apr. 7, 1964

Disclosed is a sander for dry wall plaster joints comprising a rigid rectangular plate having a bottom sanding material supporting surface, said surface being substantially plane and uninterrupted throughout its extend, said plate having a top surface and a depression in said top surface, said depression having its entire wall surface in spaced relation to said bottom surface.

European Patent Application Number EP0635335

Inventor: Christopher Cheney

Issued: Jan. 25, 1995

A conformable sanding device incorporating a flexible attachment means for ready attachment to a hand or power sander means. The sanding device is particularly useful for sanding contoured and other non-planar surfaces and angles. The sanding device comprises a compressible sanding block, said sanding block further comprising peripheral surfaces of an abrasive material; and, said sanding block further comprising a flexible attachment means. The flexible attachment means is designed for ready attachment to, and ready removable detachment from, a hand or power sanding means.

While these devices may be suitable for the purposes for which they were designed, they would not be as suitable for the purposes of the present invention, as hereinafter described.

SUMMARY OF THE PRESENT INVENTION

The present invention discloses a sanding block holder incorporating locking tabs used to lock the removable side wall into a compressing state upon the sanding block. To release compression on the sponge, the tab is simply pushed inward and the removable side wall is then pulled out. Additionally a track with a sliding tab are fabricated to work in cooperation with the handle base and locking tab to provide stability to the removable side wall while sliding into place. An elongated handle pivotally attached to the handle base is also disclosed.

A primary object of the present invention is to provide a holder for a sanding block whereby the sides extend beyond the holder;

Another object of the present invention is to provide a holder for a sanding block comprising mating holder arms;

Yet another object of the present invention is to provide a holder for a sanding block having spikes depending therefrom that engage the sanding block;

Still yet another object of the present invention is to provide a holder for a sanding block having mating locking elements on opposing holder members; and Another object of the present invention is to provide a holder having a pole receptacle pivotal longitudinally.

Additional objects of the present invention will appear as the description proceeds.

The present invention overcomes the shortcomings of the prior art by providing a sanding block holder incorporating locking tabs used to lock the removable side wall into a compressing state upon the sanding block. To release compression on the sponge, the tab is simply pushed inward and the removable side wall is then pulled out. Additionally a track with a sliding tab are fabricated to work in cooperation with the handle base and locking tab to provide stability to the removable side wall while sliding into place.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
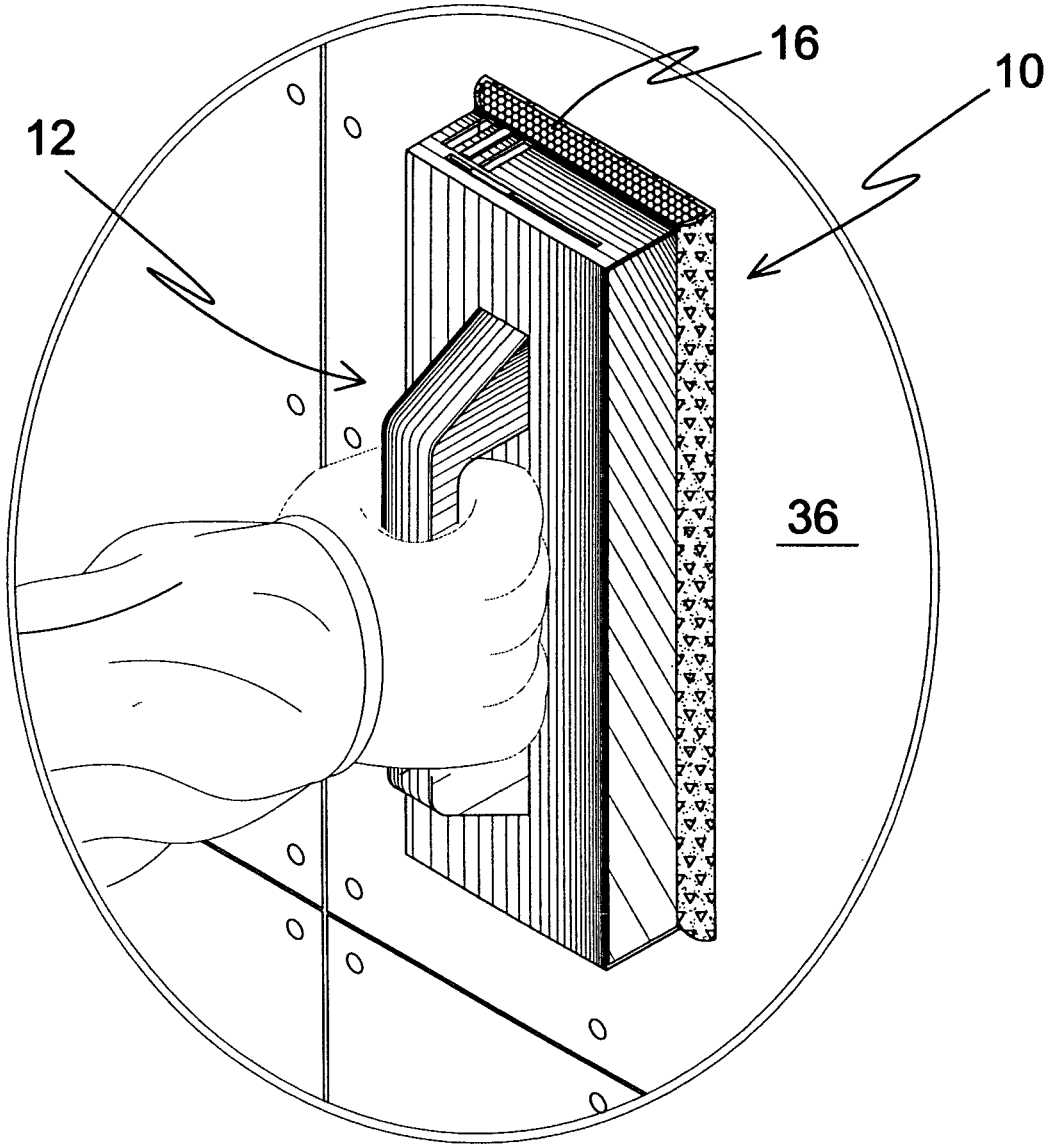
FIG. 1 is an illustrative view of the present invention in use.

With regard to reference numerals used, the following numbering is used throughout the

10 present invention
12 handle assembly
14 handle
16 sanding block
18 handle base
20 side wall
22 locking push tab
24 track
26 sliding tab
28 protrusions
30 apertures/slots
32 elongated handle
34 swivel joint
36 surface
38 flared portion
40 arrow

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 disclosing a handle assembly 12 for the securement there within a provided cavity having a side wall removable from one side of the cavity that can be adjustably resecured back into place while compressing and penetrating into a locked position, a standard polymeric sanding block 16. Additionally when the sanding block 16 is compressably secured within the provided cavity/receptacle, the compressed sanding blocks unsupported sides flare outwardly to an extent exceeding the outside perimeter edge of the handle assembly 12 allowing the user to sand flush to any surface 36 without contact of the handle assembly to any nearby projecting conjoined surface's.

Figure 2:
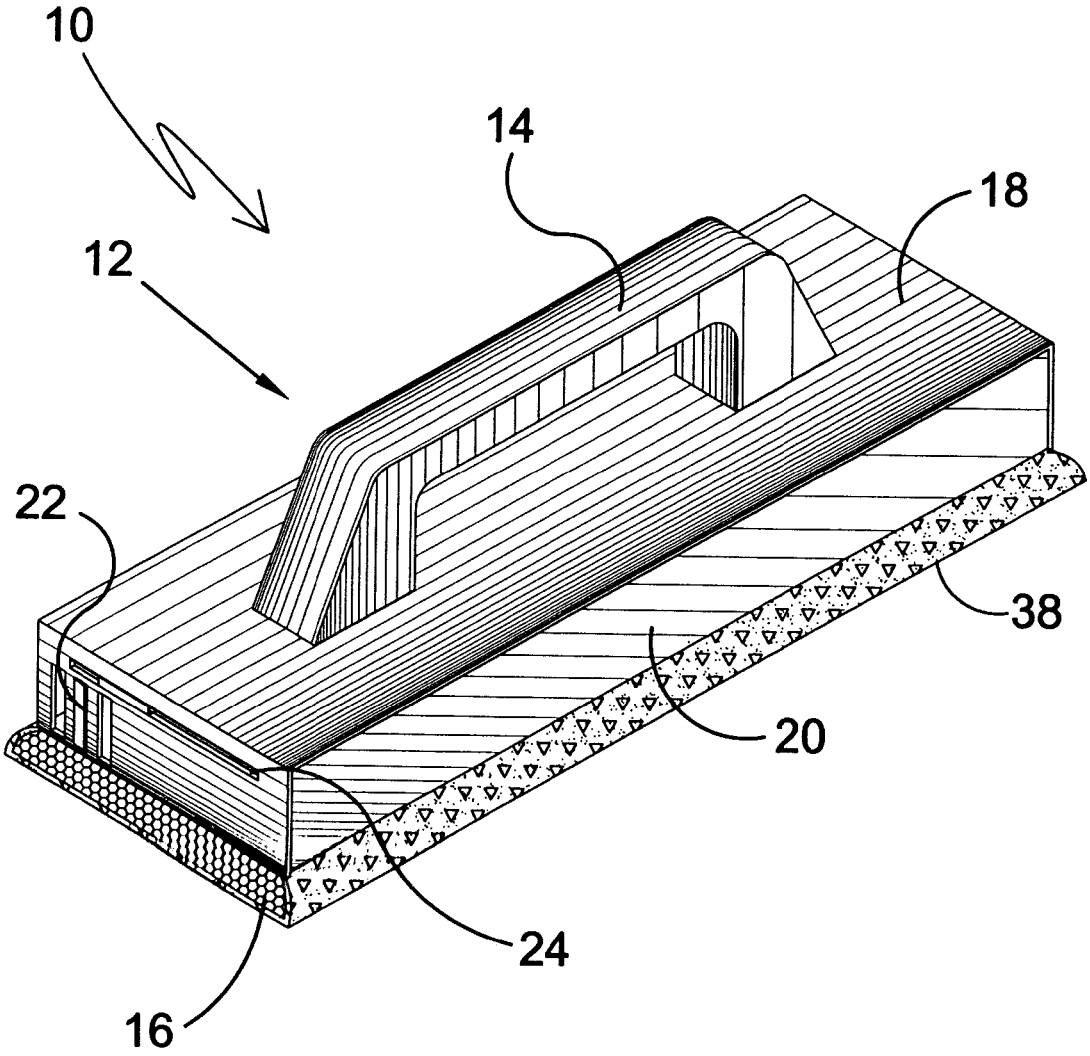
FIG. 2 is a perspective view of the present invention.

Turning to FIG. 2, shown therein is a perspective view of the present invention 10. Shown is the present invention 10 disclosing a handle assembly 12 with handle 14 for the holding of premanufactured polymeric sanding blocks 16 whereby the grasping mechanism creates compression upon the edges of the held sanding block to cause the unheld portions at 38 of the sanding block to flare out at 38 past the perimeter edge at 20 of the handle base 18 portion of the handle assembly to allow for easy clear sanding of edges. Also shown are the removable sidewall 20, locking push tab 22, and track 24.

Figure 3:
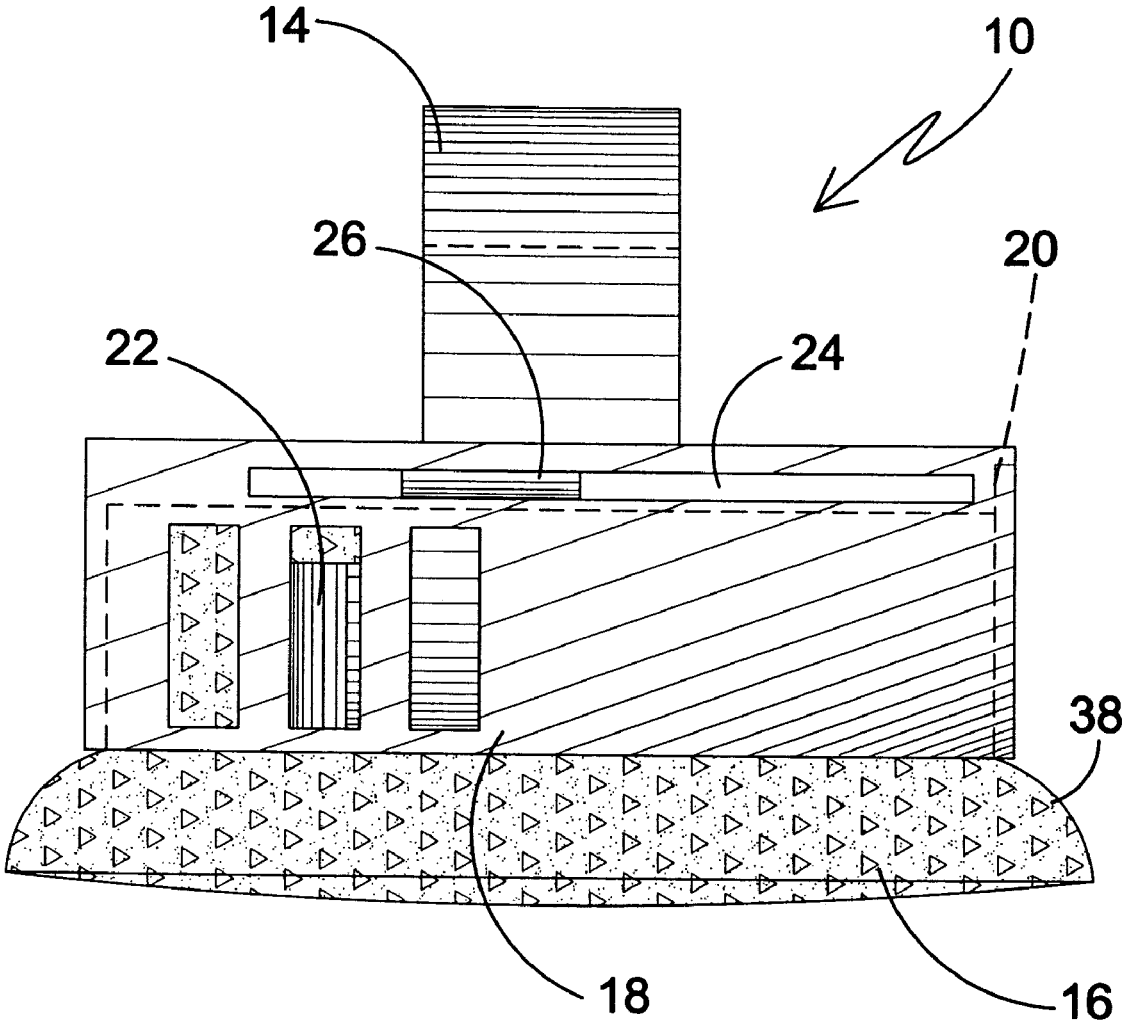
FIG. 3 is a front view of the present invention.

Turning to FIG. 3, shown therein is a front view of the present invention 10. Shown is the front of the present invention 10 showing the locking tab 22 of the present invention used to lock the removable side wall 20 into a compressing state upon the sanding block 16. To release compression on the sponge, the tab 22 is simply pushed inward and the removable side wall 20 is then pulled out. Additionally a track 24 with a sliding tab 26 are fabricated to work in cooperation with the handle base 18 and locking tab 22 to provide stability to the removable side wall 20 while sliding into place. Also shown is the handle 14 and flared portion 38.

Figure 4:
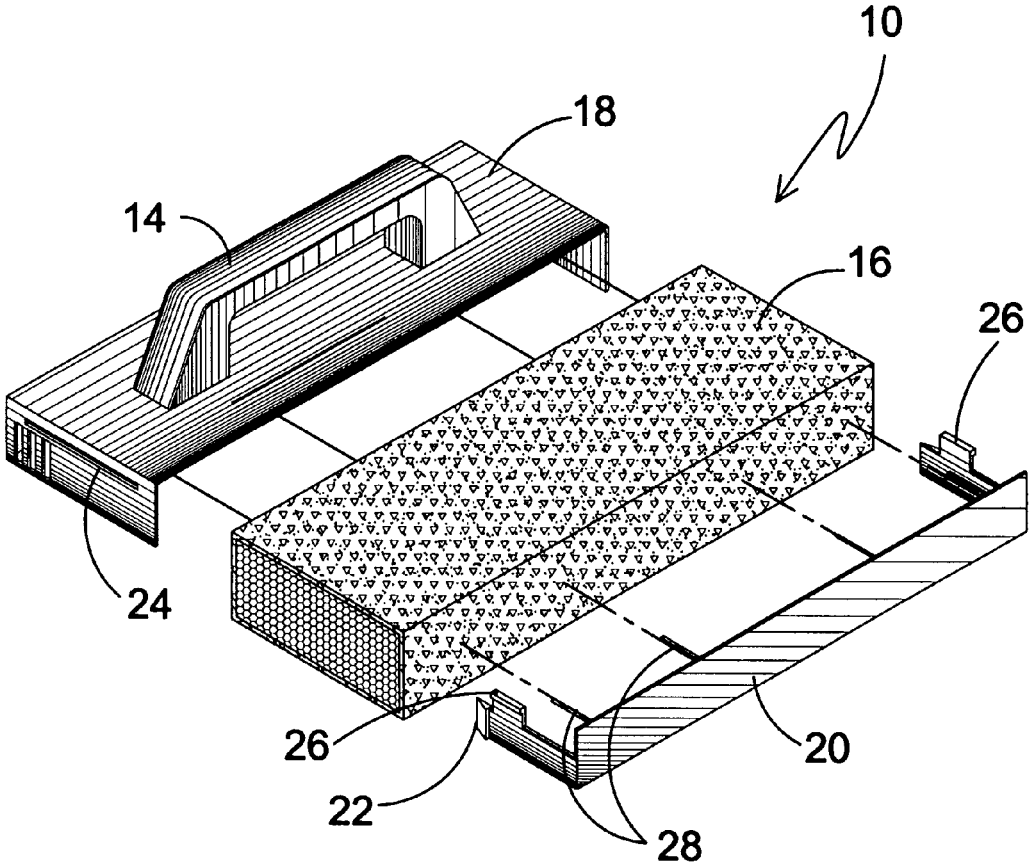
FIG. 4 is an exploded view of the present invention.

Turning to FIG. 4, shown therein is an exploded view of the present invention 10. Shown is an exploded view of the present invention 10 depicting how during installation the sanding block 16 is pressed in-between the locking tabs 22, handle base 18 and removable side wall 20 wherein the removable side wall is pressed into place inside of the handle base where it then may be adjusted and compressed into a tab locking position of sufficient compression whereby the sanding blocks unsupported side portions flare out to an extent exceeding the handle base's outside perimeter. Also shown are track 24, tab 26, handle 14 and protrusions 28.

Figure 5:
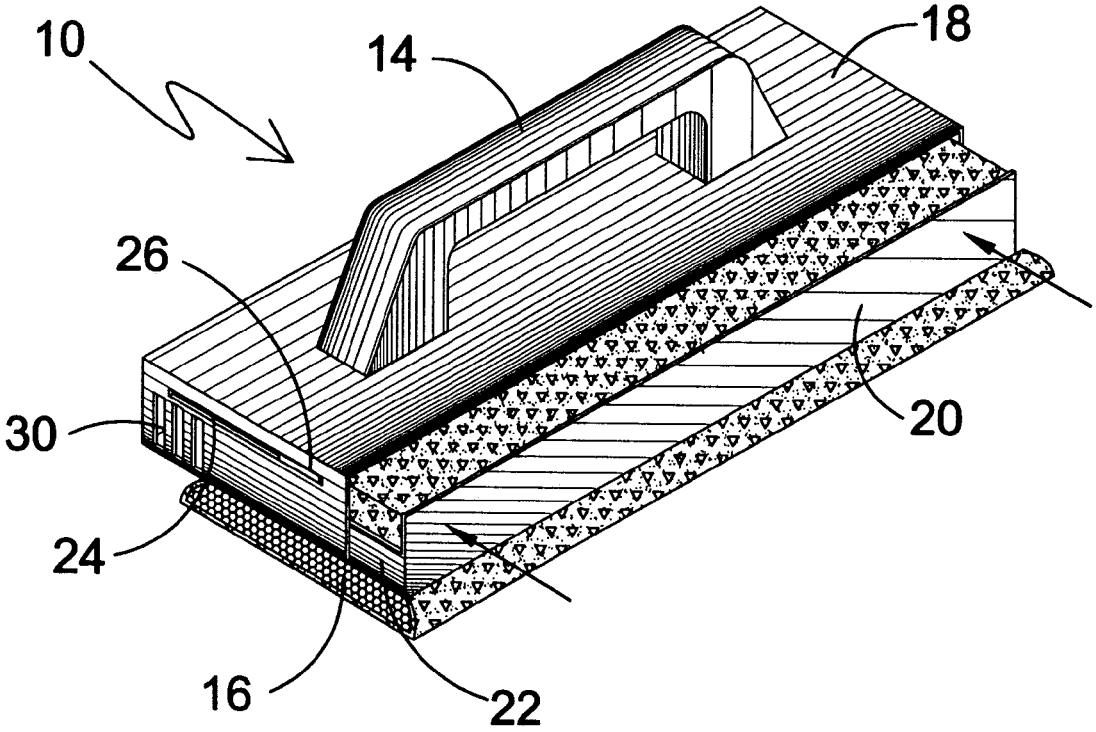
FIG. 5 is an assembly view of the present invention.

Turning to FIG. 5, shown therein is an assembly view of the present invention 10. Shown is an assembly view of the present invention 10 depicting how after the sanding block 16 is put into place finally compressing it to the desired amount is achieved simply by pushing inwardly on the removable side wall 20 until the end of the locking tab 22 locks into a slot, space or aperture 30 that inflicts a sufficient compression upon the sanding block. Other previously disclosed elements are also shown.

Figure 6:
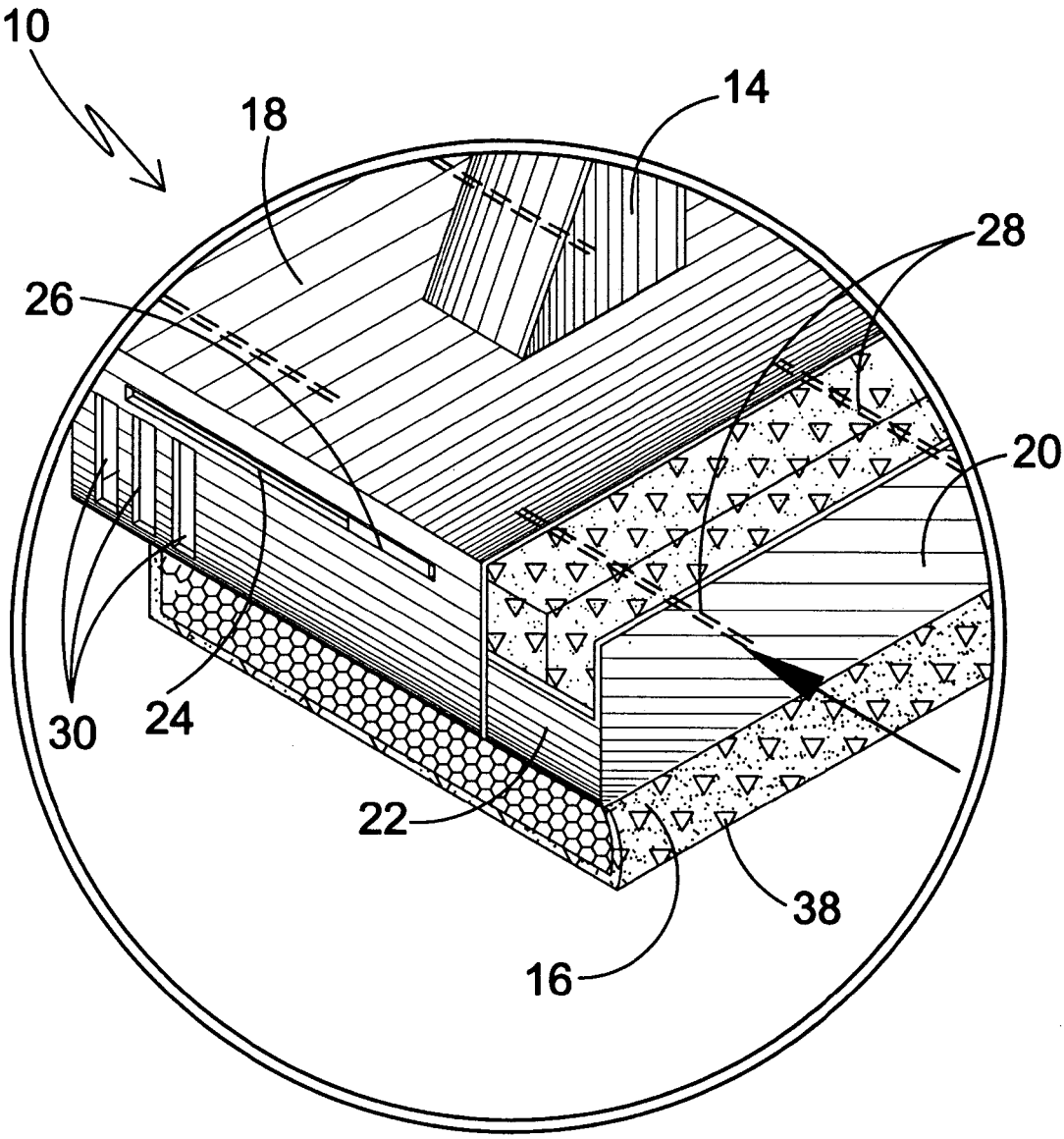
FIG. 6 is a detailed assembly view of the present invention.

Turning to FIG. 6, shown therein is a detailed assembly view of the present invention 10. Shown in detail is the process by which the sanding block 16 is secured into place by pressing upon the removable side wall 20 until the locking tab 22 is pressed into a locking position in one of the multiple slots or apertures 30. Additionally shown is the structure of the sliding tab 26 and track 24 providing a guide producing a stabilized path to travel while being pushed into place. Other previously disclosed elements are also shown.

Figure 7:
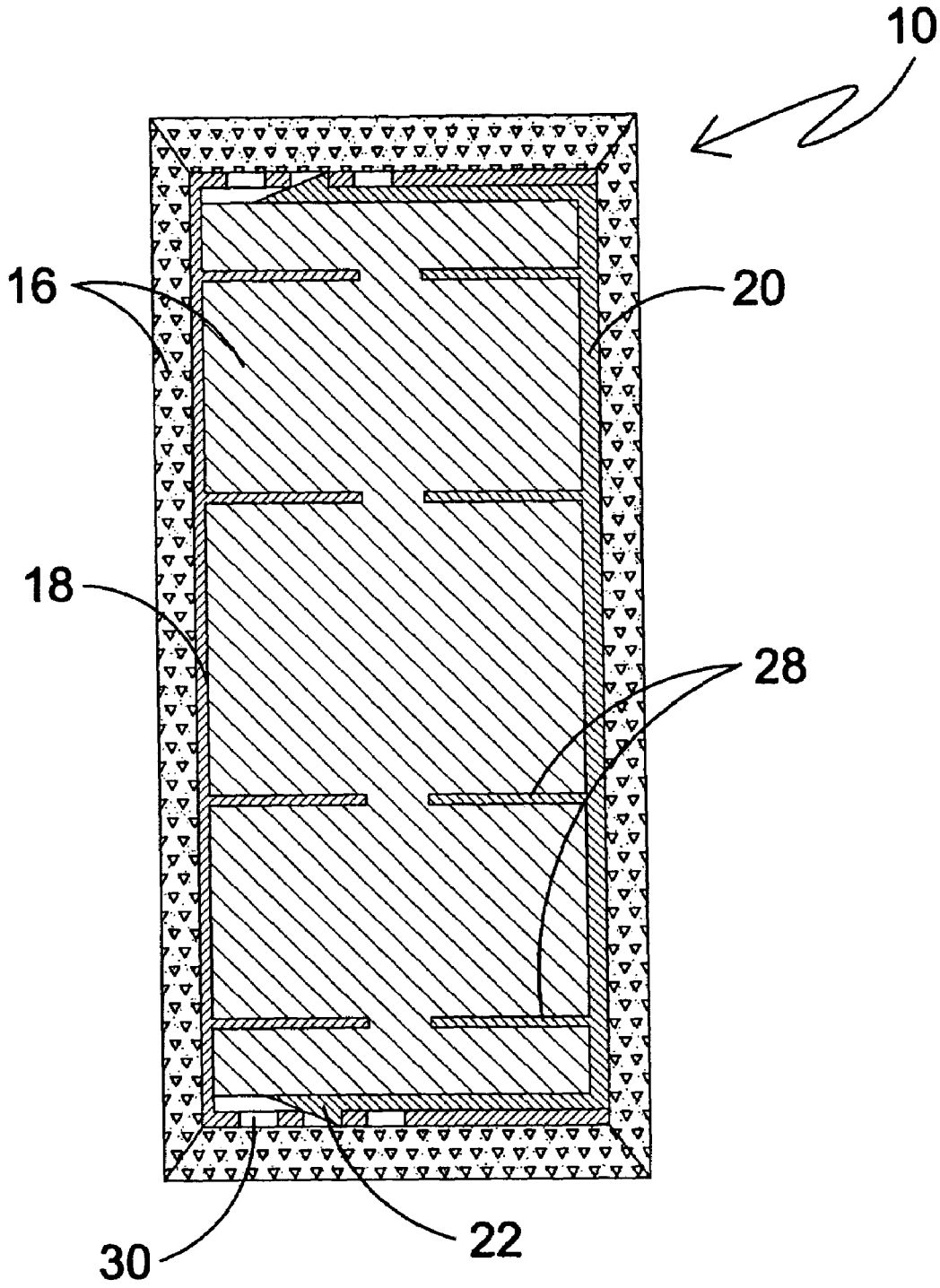
FIG. 7 is a sectional view of the present invention.

Turning to FIG. 7, shown therein is a sectional view of the present invention 10. Shown is how both the handle base 18 and removable side wall 20 both have multiple protrusions 28 projecting from their interior surfaces to penetrate the sanding block 16 to structurally lock the block in place. Also shown are a plurality of apertures 30 in the base handle's 18 side portions to receive the locking tab 22 in a plurality of inwardly compressing positions.

Figure 8:
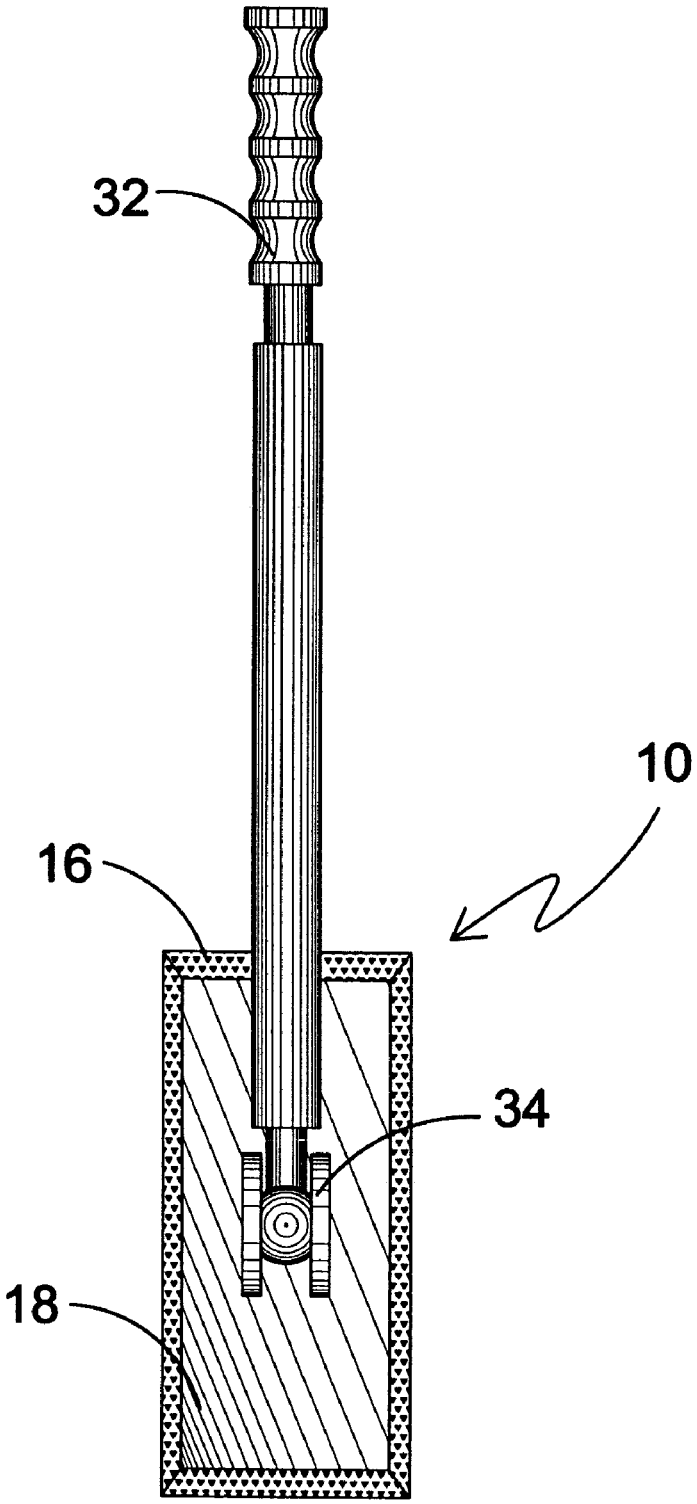
FIG. 8 is a top view of an additional element of the present invention.

Turning to FIG. 8, shown therein is a top view of an additional element of the present invention 10. Shown is the present invention 10 having an additional element being an elongated handle 32 attached to the handle base 18 by a swivel joint 34 that allows for the handle to be manipulated in a side to side motion to make reaching high or hard to reach locations an easier task. Sanding block 16 is also shown.

Figure 9:
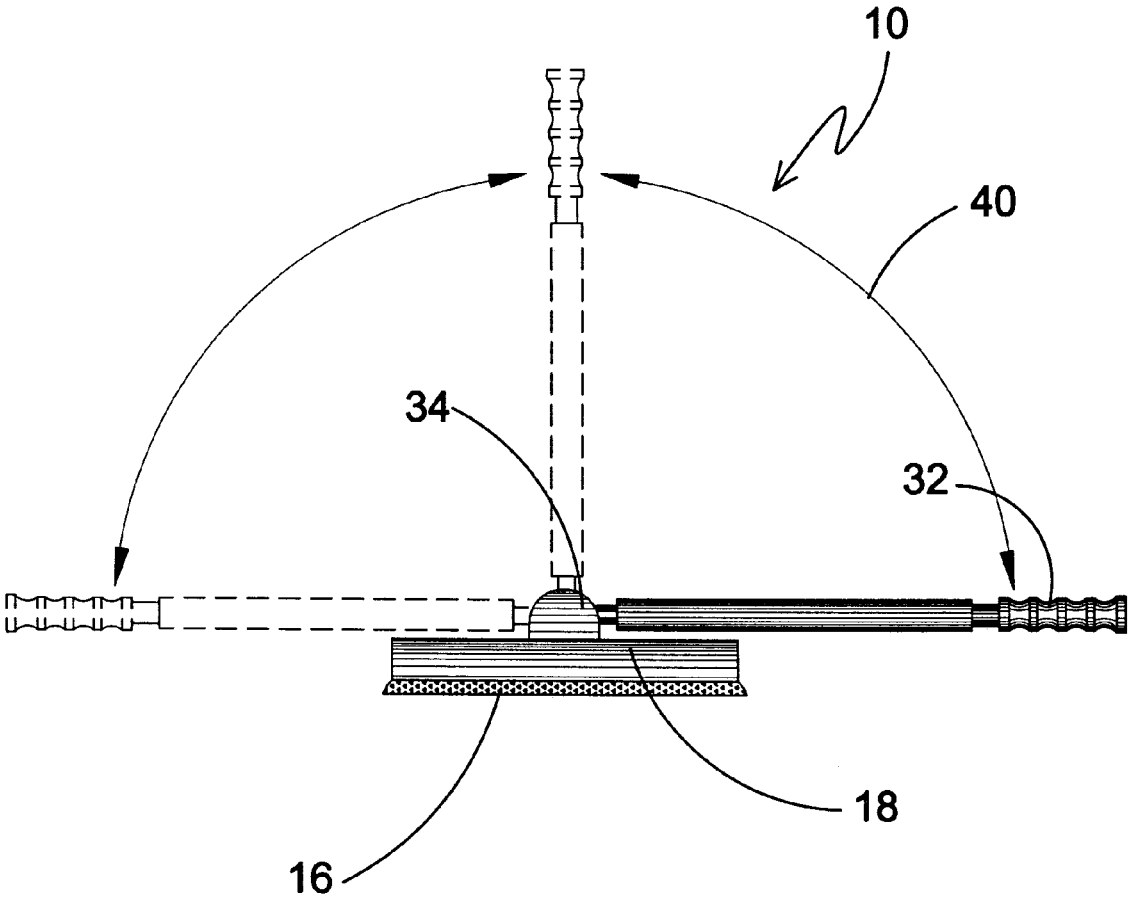
FIG. 9 is a side view of an additional element of the present invention.

Turning to FIG. 9, shown therein is a side view of an additional element of the present invention 10. Shown is the present invention 10 having an additional element being an elongated handle 32 attached to the handle base 18 by a swivel joint 34 that allows for the handle to be manipulated in a 180 degree side to side motion to make reaching high or hard to reach locations an easier task. Additionally shown is the range of motion at arrow 40 of the handle 32 provided by the swivel joint 34 and sanding block 16.

I claim:

1. An apparatus for holding a sanding block, the sanding block having an upper and a lower portion, comprising:

a) a handle assembly having a top and bottom portion, first and second ends, first and second edges and downwardly extending sides forming a receptacle therein, wherein said sides each have an inner surface, wherein said receptacle compressibly holds the upper portion of a compressible sanding block therein;

b) wherein one of said sides on one of said edges is removably attached to said handle assembly said removably attached side being laterally movable inwardly and outwardly so as to capture the upper portion of the sanding block therein between said inner surface of said removably attached side and said inner surfaces of said remaining sides of said receptacle so as to compressibly hold the sanding block therein when said removably attached side is moved inwardly; and, c) wherein the lower portion of the sanding block protrudes beyond said sides of said receptacle due to the compression placed on the upper portion thereof so as to allow a user to sand flush to any proximate side surface without said handle assembly touching the proximate side surface.

2. The apparatus of claim 1, further comprising a handle being disposed on said top of said handle assembly to permit a user to grasp the apparatus.

3. The apparatus of claim 2, further comprising an elongated handle being pivotally disposed on said top of said handle assembly to permit a user to sand surfaces located at a distance from the user.

4. The apparatus of claim 3, wherein said downwardly extending sides on said first and second ends of said handle assembly each have a plurality of vertically disposed slots therein, wherein said removably attached side has a first and second locking tab disposed on each of said first and second ends thereof, respectively, so that said locking tabs are slidably insertable within one of said slots so as to allow the amount of compression on the sanding block to be adjusted as said removably attached side is moved inwardly and outwardly.

5. The apparatus of claim 4, wherein said plurality of slots are placed side by side in a spaced apart manner so that said locking tabs are slidably insertable within one of said slots so as to allow the amount of compression on the sanding block to be adjusted as said removably attached side is moved inwardly and outwardly.

6. The apparatus of claim 5, wherein said locking tabs are perpendicularly disposed on said inner surface of said removably attached side.

7. The apparatus of claim 6, wherein said downwardly extending sides on said first and second ends of said handle assembly each have a horizontally disposed track therein, wherein said locking tabs each have a sliding tab disposed thereon so that said sliding tabs are each slidably insertable within one of said tracks to provide additional strength to said locking tab as said removably attached side is moved inwardly and outwardly.

8. The apparatus of claim 7, further comprising a plurality of inwardly extending protrusions being disposed on said first and second side edges of said handle assembly so that said protrusions penetrate the sanding block so as to capture the sanding block therein.

9. The apparatus of claim 8, wherein said protrusions lie in substantially the horizontal plane.

10. The apparatus of claim 9, wherein said elongated handle is 180 degrees pivotal from a first side of said handle assembly to a second side of said handle assembly.

11. The apparatus of claim 10, wherein said handle assembly is rectangular shaped.

12. The apparatus of claim 11, wherein said edges of said handle assembly are longer than said ends of said handle assembly.

* * * * *